US012575650B2

(12) United States Patent
François et al.

(10) Patent No.: US 12,575,650 B2
(45) Date of Patent: Mar. 17, 2026

(54) BRACELET AND METHOD FOR MANUFACTURING SUCH A BRACELET

(71) Applicant: The Swatch Group Research and Development Ltd, Marin (CH)

(72) Inventors: Nicolas François, Neuchatel (CH); Sophie Napoli, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 25 days.

(21) Appl. No.: 18/515,389

(22) Filed: Nov. 21, 2023

(65) Prior Publication Data

US 2024/0206600 A1 Jun. 27, 2024

(30) Foreign Application Priority Data

Dec. 27, 2022 (EP) ..... 22216777

(51) Int. Cl.
*A44C 5/00* (2006.01)
*A44C 27/00* (2006.01)

(52) U.S. Cl.
CPC ..... *A44C 5/0053* (2013.01); *A44C 27/001* (2013.01)

(58) Field of Classification Search
CPC ..... A44C 5/0053; A44C 27/001
See application file for complete search history.

(56) References Cited

U.S. PATENT DOCUMENTS

| | | | | |
|---|---|---|---|---|
| 11,946,479 | B2 * | 4/2024 | Schwimmer | F04D 25/0673 |
| 2007/0088104 | A1 * | 4/2007 | Hung | A61K 8/731 524/319 |
| 2018/0364646 | A1 | 12/2018 | Rannoux et al. | |
| 2022/0273177 | A1 * | 9/2022 | Tolentino | A61B 5/681 |
| 2022/0362571 | A1 * | 11/2022 | Lambert | A61N 5/04 |

FOREIGN PATENT DOCUMENTS

| | | | |
|---|---|---|---|
| CN | 213820105 | U | 7/2021 |
| EP | 3 178 344 | A1 | 6/2017 |
| FR | 3 093 398 | A1 | 9/2020 |

OTHER PUBLICATIONS

Office Action issued Dec. 10, 2024, in corresponding Japanese Patent Application No. 2023-183715 (with English Translation), 8 pages.

European Search Report issued May 25, 2023 in European Application 22216777.7 filed on Dec. 27, 2022 , 3 pages (with English Translation of Categories of Cited Documents).

* cited by examiner

*Primary Examiner* — Derek J Battisti
(74) *Attorney, Agent, or Firm* — Oblon, McClelland, Maier & Neustadt, L.L.P.

(57) ABSTRACT

A bracelet including an upper strip and a lower strip forming at least one strand of the bracelet, the bracelet includes a flexible intermediate layer disposed between the upper strip and the lower strip, the flexible intermediate layer being formed by at least one encapsulated phase-change material having a transition temperature of between 0° C. and 40° C.

9 Claims, 1 Drawing Sheet

A-A

BRACELET AND METHOD FOR MANUFACTURING SUCH A BRACELET

CROSS-REFERENCE TO RELATED APPLICATION

This application claims priority to European Patent Application No. 22216777.7 filed on Dec. 27, 2022, the entire disclosure of which is hereby incorporated herein by reference.

TECHNICAL FIELD OF THE INVENTION

The invention relates to a flexible, deformable bracelet or wristband for the watchmaking, jewellery or leather goods industries, and to a manufacturing method for obtaining such a bracelet.

TECHNOLOGICAL BACKGROUND

Conventionally, watch bracelets are made of leather, synthetic materials, fabric, rubber or metal. The bracelets further comprise an insert disposed in a lining or sheath or between an upper strip and a lower strip which are subsequently joined together. This insert has a primarily mechanical and flexible function.

In the case of a leather bracelet, the insert is made up of tear-resistant reinforcement and padding made of leather and a non-woven material to make the bracelet raised. A leather lining is also provided, along with a leather or synthetic top.

In an alternative embodiment, the bracelet has a top, which is turned-in only on the sides of the bracelet so that it is of the semi-turned-in type. Semi-turned-in or machine-turned-in bracelets are produced using a mould and a platen press.

A bracelet made of elastomer material can also be conceived, wherein several layers are bonded and/or welded together and encase an insert. A preform can then be cut to the shape of each bracelet strand using a press. The edges of the bracelet can then be protected with an edge lacquer and stitched.

Some bracelets have been made by combining these elastomer-type materials with typical high-end leathers to improve the durability of these bracelets without altering their appearance when the watch is worn.

However, these bracelets generally comprise different parts made of different materials that are typically stitched or bonded together, which can lead to these parts becoming detached over time. Furthermore, the assembly of these different parts does not allow sufficient and/or satisfactory personalisation and/or decoration.

SUMMARY OF THE INVENTION

The aim of the invention is to provide a bracelet comprising a functional and comfortable insert, as well as a method for manufacturing such bracelets featuring a combination of closely bonded materials and allowing for a multitude of customisation options.

To this end, the invention relates to a bracelet comprising an upper strip and a lower strip forming at least one strand of the bracelet, said bracelet being characterised in that it comprises a flexible intermediate layer disposed between the upper strip and the lower strip, the flexible intermediate layer being formed by at least one encapsulated phase-change material having a transition temperature of between 0° C. and 40° C.

According to other advantageous alternative embodiments of the invention:

- the at least one phase-change material is selected from: paraffinic hydrocarbons, halogenated hydrocarbons, waxes, oils, hydrated salts, fatty acids, fatty acid esters, dibasic acids, dibasic esters, 1-halides, polymers, and mixtures thereof;
- the lower strip comprises micro-perforations;
- the upper and lower strips are made from elastomer composites containing metallic and/or ceramic fillers in order to improve heat exchanges;
- the predetermined temperature threshold is between 25° C. and 30° C.;
- the layer of encapsulated phase-change material comprises holes for passing fastening means;
- the upper strip is made of one or more materials selected from the group comprising leathers, natural or synthetic fabrics, elastomers and silicone materials;
- the flexible intermediate layer is formed by two encapsulated phase-change materials, a first encapsulated phase-change material having a transition temperature between 15° C. and 25° C., and a second encapsulated phase-change material having a transition temperature between 26° C. and 35° C.

An advantage of a bracelet according to the invention lies in the fact that the insert is sufficiently thin that it can replace a conventional reinforcing insert without increasing the conventional thickness of such a bracelet, while providing one or more additional functions.

The invention also relates to a method for manufacturing the bracelet, which includes the features defined in the independent claim 9.

BRIEF DESCRIPTION OF THE FIGURES

The aims, advantages and features of the bracelet provided with a phosphorescent insert will become clearer in the following description given with reference to the drawings in which.

DETAILED DESCRIPTION OF THE INVENTION

Figure 1:
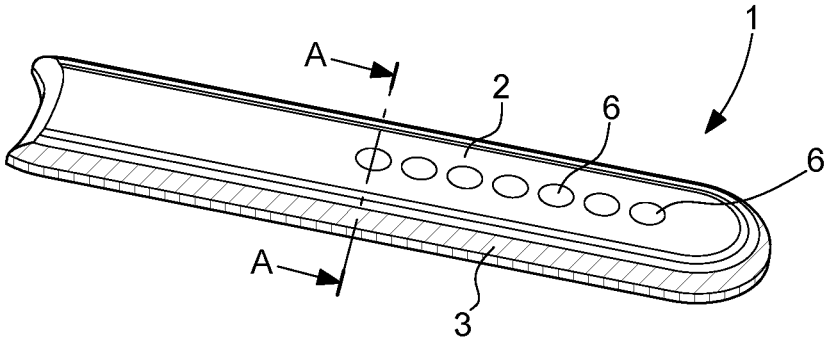
FIG. 1 shows a bracelet provided with an intermediate layer according to a first embodiment of the invention.
Figure 2:
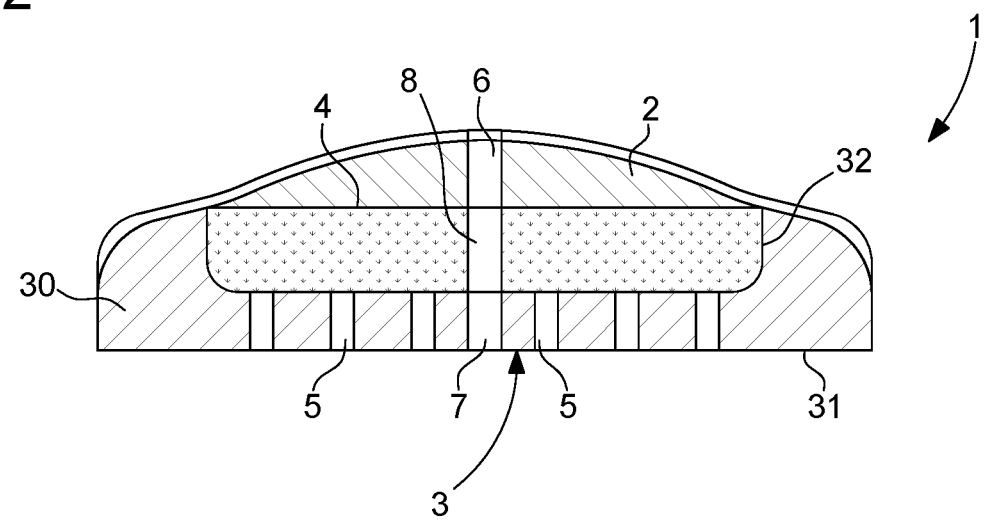
FIG. 2 shows a sectional view of a bracelet strand according to the invention.

A first aspect of the invention relates to a bracelet or wristband 1 comprising an upper strip 2 and a lower strip 3 forming at least one strand of the bracelet 1, each strip having corresponding holes 6 for passing a pin or tongue. The bracelet further comprises an insert disposed between the upper strip 2 and the lower strip 3, the insert being in the form of a flexible intermediate layer 4 disposed between the upper strip 2 and the lower strip 3.

The term 'upper' is understood to mean the part of the bracelet that faces outwards and is visible to the wearer when the bracelet is being worn. Similarly, the term 'lower' is understood to mean the part of the bracelet that faces inwards and that is in contact with the wearer when the bracelet is being worn.

Advantageously, the flexible intermediate layer 4 is formed by at least one encapsulated phase-change material with a transition temperature of between 0° C. and 40° C., so as to be able to release or absorb heat when the bracelet is in contact with the wearer's skin.

The transition temperature is, for example, between 25° C. and 30° C. Once this temperature has been reached, the phase-change material will absorb the wearer's heat and provide a cooling sensation thereto.

The reverse is also possible. The transition temperature may, for example, be between 15° C. and 20° C. Once this temperature has been reached, the phase-change material will release heat to the wearer, providing a heating sensation thereto.

The intermediate layer 4 further comprises holes 8 corresponding to the holes in the upper and lower strips for passing a pin or tongue.

The intermediate layer 4 is bonded to the upper strip 2 and lower strip 3 so that the intermediate layer 4 does not move once the bracelet has been assembled.

Conventionally, the upper strip 2 and the lower strip 3 are made from one or more materials selected from the group comprising leathers, natural or synthetic fabrics, elastomers, elastomer composites containing metallic and/or ceramic fillers, and silicone materials. These materials can also be combined, depending on the wearer's wishes.

According to one embodiment of the invention, the lower strip 3 comprises micro-perforations 5 to enable better conduction of heat from the wearer to the encapsulated phase-change material and/or vice versa.

The elastomer can be chosen from fluorinated elastomers such as those in the FKM family (cross-linkable fluoro or perfluoropolyalkylene) or thermoplastic elastomers such as TPU (polyurethanes), EVA (ethylene vinyl acetate copolymer), silicones, EPR (ethylene propylene rubber) and their thermoplastic derivatives (TPO) or from the acrylic elastomer family. The chosen elastomer also has the advantage of being relatively flexible in order to adapt to the curvature of the wrist when the bracelet is being worn.

The intermediate layer 4 is sufficiently thin that it can replace a conventional reinforcing insert without increasing the conventional thickness of such a bracelet, while providing an additional effect.

According to the invention, the at least one phase-change material is selected from: paraffinic hydrocarbons, halogenated hydrocarbons, waxes, oils, hydrated salts, fatty acids, fatty acid esters, dibasic acids, dibasic esters, 1-halides, polymers, and mixtures thereof.

The phase-change material is encapsulated in a casing made of a silicone or thermoplastic elastomer material, enabling the intermediate layer 4 to be easily bonded to the upper strip 2 and lower strip 3.

According to one embodiment of the invention, the flexible intermediate layer 4 is formed by a pocket containing a liquid such as a mineral or vegetable oil and microcapsules of a phase-change material.

Again, according to one particular embodiment of the invention, the flexible intermediate layer 4 is formed by two encapsulated phase-change materials, a first encapsulated phase-change material having a transition temperature between 15° C. and 20° C., and a second encapsulated phase-change material having a transition temperature between 25° C. and 35° C. Such an arrangement makes it possible for several functions to be combined, such as those of heating the wearer when the transition temperature is between 15° C. and 20° C., and cooling the wearer when the transition temperature is between 25° C. and 35° C.

The invention further relates to a method for manufacturing such a bracelet, which method comprises the steps of:

manufacturing a flexible intermediate layer 4 formed by at least one encapsulated phase-change material corresponding to the desired final shape of the bracelet, providing an upper strip 2 and a lower strip 3, bonding the intermediate layer 4 to the lower strip 3, and rigidly connecting the upper strip 2 to the lower strip 3 and the intermediate layer 4 to form the bracelet.

The upper strip 2 and lower strip 3 are rigidly connected together, for example by bonding, stitching or welding.

Thanks to these features, the two strips 2, 3 and the intermediate layer 4 are closely bonded together, ensuring a high level of robustness and excellent durability of the bracelet thus produced.

The upper strip 2 can also be overmoulded. In this case, a groove or moulding can be provided around the opening to improve the aesthetics of the assembly. Indeed, such a groove or moulding makes it possible to at least partially conceal the material transitions between the different parts of the bracelet.

Thanks to the manufacturing method described above, numerous variations in the functions of a flexible bracelet can be created for the well-being of the wearer.

Moreover, these bracelets are extremely durable, even when exposed to water or sweat.

The invention claimed is:

1. A bracelet comprising an upper strip and a lower strip forming at least one strand of the bracelet, the bracelet comprising a flexible intermediate layer disposed between the upper strip and the lower strip, the flexible intermediate layer being formed by two encapsulated phase-change materials, a first encapsulated phase-change material having a transition temperature between 15° C. and 20° C., and a second encapsulated phase-change material having a transition temperature between 25° C. and 35° C.

2. The bracelet according to claim 1, wherein the phase-change materials are selected from: paraffinic hydrocarbons, halogenated hydrocarbons, waxes, oils, hydrated salts, fatty acids, fatty acid esters, dibasic acids, dibasic esters, 1-halides, polymers, and mixtures thereof.

3. The bracelet according to claim 2, wherein the lower strip comprises micro-perforations.

4. The bracelet according to claim 1, wherein the upper strip and the lower strip are made from elastomer composites containing metallic and/or ceramic fillers.

5. The bracelet according to claim 1, wherein the intermediate layer made of the encapsulated phase-change material comprises holes for passing fastening devices.

6. The bracelet according to claim 1, wherein the upper strip is made of one or more materials selected from the group comprising leathers, natural or synthetic fabrics, elastomers and silicone materials.

7. A method for manufacturing a bracelet according to claim 1, wherein the method comprises:

manufacturing a flexible intermediate layer formed by the two encapsulated phase-change materials corresponding to a desired final shape of the bracelet, providing an upper strip and a lower strip, bonding the intermediate layer to the lower strip, and rigidly connecting the upper strip to the lower strip and the intermediate layer to form the bracelet.

8. The bracelet according to claim 1, wherein the lower strip comprises a surface with micro-perforations having openings configured to be in contact with the wearer and with the flexible intermediate layer and extending between the flexible intermediate layer and the surface.

9. The bracelet according to claim 8, wherein the intermediate layer made of the encapsulated phase-change material comprises holes for passing fastening devices disposed adjacent to the micro-perforations.

* * * * *